US008682670B2

(12) United States Patent
Shechtman et al.

(10) Patent No.: US 8,682,670 B2
(45) Date of Patent: Mar. 25, 2014

(54) STATISTICAL ENHANCEMENT OF SPEECH OUTPUT FROM A STATISTICAL TEXT-TO-SPEECH SYNTHESIS SYSTEM

(75) Inventors: Slava Shechtman, Haifa (IL); Alexander Sorin, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 203 days.

(21) Appl. No.: 13/177,577

(22) Filed: Jul. 7, 2011

(65) Prior Publication Data

US 2013/0013313 A1 Jan. 10, 2013

(51) Int. Cl.
*G10L 13/00* (2006.01)

(52) U.S. Cl.
USPC ..... 704/260; 704/219

(58) Field of Classification Search
USPC ..... 704/260
See application file for complete search history.

(56) References Cited

U.S. PATENT DOCUMENTS

| | | | | |
|---|---|---|---|---|
| 3,472,964 | A * | 10/1969 | Hogue | 704/261 |
| 5,067,158 | A * | 11/1991 | Arjmand | 704/219 |
| 6,256,609 | B1 * | 7/2001 | Byrnes et al. | 704/246 |
| 6,266,638 | B1 * | 7/2001 | Stylianou | 704/266 |
| 6,430,522 | B1 * | 8/2002 | O'Brien et al. | 702/181 |
| 7,035,791 | B2 * | 4/2006 | Chazan et al. | 704/207 |
| 7,765,101 | B2 * | 7/2010 | En-Najjary et al. | 704/246 |
| 8,244,534 | B2 * | 8/2012 | Qian et al. | 704/256.3 |
| 8,321,222 | B2 * | 11/2012 | Pollet et al. | 704/260 |
| 2001/0056347 | A1 * | 12/2001 | Chazan et al. | 704/258 |
| 2002/0026253 | A1 * | 2/2002 | Rajan | 700/94 |
| 2003/0097256 | A1 | 5/2003 | Kleijn | |
| 2004/0086179 | A1 * | 5/2004 | Ma et al. | 382/177 |
| 2005/0192806 | A1 | 9/2005 | Han et al. | |
| 2009/0048841 | A1 * | 2/2009 | Pollet et al. | 704/260 |
| 2010/0004931 | A1 * | 1/2010 | Ma et al. | 704/244 |
| 2010/0211382 | A1 * | 8/2010 | Sugiyama | 704/205 |
| 2011/0218804 | A1 * | 9/2011 | Chun | 704/243 |

(Continued)

OTHER PUBLICATIONS

Zen et al (hereinafter Zen) "Statistical parametric speech Synthesis" available at www.elsevier.com/locate/specom, Apr. 2009.*

(Continued)

*Primary Examiner* — Paras D Shah
*Assistant Examiner* — Jie Shan

(57) ABSTRACT

A method, system and computer program product are provided for enhancement of speech synthesized by a statistical text-to-speech (TTS) system employing a parametric representation of speech in a space of acoustic feature vectors. The method includes: defining a parametric family of corrective transformations operating in the space of the acoustic feature vectors and dependent on a set of enhancing parameters; and defining a distortion indictor of a feature vector or a plurality of feature vectors. The method further includes: receiving a feature vector output by the system; and generating an instance of the corrective transformation by: calculating a reference value of the distortion indicator attributed to a statistical model of the phonetic unit emitting the feature vector; calculating an actual value of the distortion indicator attributed to feature vectors emitted by the statistical model of the phonetic unit emitting the feature vector; calculating the enhancing parameter values depending on the reference value of the distortion indicator, the actual value of the distortion indicator and the parametric corrective transformation; and deriving an instance of the corrective transformation corresponding to the enhancing parameter values from the parametric family of the corrective transformations. The instance of the corrective transformation may be applied to the feature vector to provide an enhanced feature vector.

25 Claims, 8 Drawing Sheets

(56) References Cited

U.S. PATENT DOCUMENTS

| | | | | |
|---|---|---|---|---|
| 2011/0303748 | A1* | 12/2011 | Lemma et al. | 235/454 |
| 2012/0065961 | A1* | 3/2012 | Latorre et al. | 704/9 |
| 2012/0265534 | A1* | 10/2012 | Coorman et al. | 704/265 |

OTHER PUBLICATIONS

Mizuno "Voice conversion based on piecewise linear conversion rule of formant frequency and spectrum tilt," in Proc. IEEE Int. Conf. Acoustics, Speech, Signal Processing, 1994.*

Tiomkin) "Statistical Text-to-Speech Synthesis Based on Segment-Wise Representation With a Norm Constraint" IEEE Transactions on Audio, Speech, and Language Processing, vol. 18, No. 5, Jul. 2010 (current version published Jun. 16, 2010).*

K. Koishida et al., "CELP coding based on mel-cepstral analysis", Proc ICASSP 1995.

J.H. Chen et al., "Adaptive Postfiltering for Quality Enhancement of Coded Speech", IEEE Trans. On Speech and Audio Proc. vol. 3 No. 1 Jan. 1995.

T. Yoshimura et al. "Incorporating a Mixed Excitation Model and Postfilter into HMM-Based Text-to-Speech Synthesis", Systems and Computers in Japan, vol. 36, No. 12, 2005.

B. Juang et al., "On the use of bandpass liftering in speech recognition", IEEE Trans. Acoust., Speech, Signal Processing, vol. 35, pp. 947-954, Jul. 1987.

Tohkura, Y, "A Weighted Cepstral Distance Measure for Speech Recognition", Acoustics, Speech and Signal Processing, IEEE Transactions on; Issue Date: Oct. 1987; vol. 35, Issue: 10; on pp. 1414-1422; ISSN: 0096-3518, Date of Current Version: Jan. 29, 2003.

* cited by examiner

STATISTICAL ENHANCEMENT OF SPEECH OUTPUT FROM A STATISTICAL TEXT-TO-SPEECH SYNTHESIS SYSTEM

BACKGROUND

This invention relates to the field of synthesized speech. In particular, the invention relates to statistical enhancement of synthesized speech output from a statistical text-to-speech (TTS) synthesis system.

Synthesized speech is artificially produced human speech generated by computer software or hardware. A TTS system converts language text into a speech signal or waveform suitable for digital-to-analog conversion and playback.

One form of TTS system uses concatenating synthesis in which pieces of recorded speech are selected from a database and concatenated to form the speech signal conveying the input text. Typically, the stored speech pieces represent phonetic, units e.g. sub-phones, phones, diphones, appearing in certain phonetic-linguistic context.

Another class of speech synthesis, referred to as "statistical TTS", creates the synthesized speech signal by statistical modeling of the human voice. Existing statistical TTS systems are based on hidden Markov models (HMM) with Gaussian mixture emission probability distribution, so "HMM TTS" and "statistical TTS" may sometimes be used synonymously. However, in principle a statistical TTS system may employ other types of models. Hence the description of the present invention addresses statistical TTS in general while HMM TTS is considered a particular example of the former.

In an HMM-based system the frequency spectrum (vocal tract), fundamental frequency (vocal source), and duration (prosody) of speech may be modeled simultaneously by HMMs. Speech waveforms may be generated from HMMs based on the maximum likelihood criterion.

HMM-based TTS systems have gained increased popularity in the industry and speech research community due to certain advantages of this approach over the concatenative synthesis paradigm. However, it is commonly acknowledged that HMM TTS systems produce speech of dimmed quality lacking crispiness and liveliness that are present in natural speech and preserved to a big extent in concatenative TTS output. In general, the dimmed quality in HMM-based systems is accounted to spectral shape smearing and in particular to formants widening as a result of statistical modeling that involves averaging of vast amount (e.g. thousands) of feature vectors representing speech frames.

The formant smearing effect has been known for many years in the field of speech coding, although in HMM TTS this effect has stronger negative impact on the perceptual quality of the output. Some speech enhancement techniques (also known as, postfiltering) have been developed for speech codecs in order to compensate quantization noise and sharpen the formants at the decoding phase. Some TTS systems follow this approach and employ a post-processing enhancement step aimed at partial compensation of the spectral smearing effect.

BRIEF SUMMARY

According to a first aspect of the present invention there is provided a method for enhancement of speech synthesized by a statistical text-to-speech (TTS) system employing a parametric representation of speech in a space of acoustic feature vectors, comprising: defining a parametric family of corrective transformations operating in the space of the acoustic feature vectors and dependent on a set of enhancing parameters; defining a distortion indictor of a feature vector or a plurality of feature vectors; receiving a feature vector output by the system; generating an instance of the corrective transformation by: calculating a reference value of the distortion indicator attributed to a statistical model of the phonetic unit emitting the feature vector; calculating an actual value of the distortion indicator attributed to feature vectors emitted by the statistical model of the phonetic unit emitting the feature vector; calculating the enhancing parameter values depending on the reference value of the distortion indicator, the actual value of the distortion indicator and the parametric corrective transformation; deriving an instance of the corrective transformation corresponding to the enhancing parameter values from the parametric family of the corrective transformations; and applying the instance of the corrective transformation to the feature vector to provide an enhanced feature vector.

According to a second aspect of the present invention there is provided a computer program product for enhancement of speech synthesized by a statistical text-to-speech (TTS) system employing a parametric representation of speech in a space of acoustic feature vectors, the computer program product comprising: a computer readable non-transitory storage medium having computer readable program code embodied therewith, the computer readable program code comprising: computer readable program code configured to: define a parametric family of corrective transformations operating in the space of the acoustic feature vectors and dependent on a set of enhancing parameters; define a distortion indictor of a feature vector or a plurality of feature vectors; receive a feature vector output by the system; generate an instance of the corrective transformation by: calculating a reference value of the distortion indicator attributed to a statistical model of the phonetic unit emitting the feature vector; calculating an actual value of the distortion indicator attributed to feature vectors emitted by the statistical model of the phonetic unit emitting the feature vector; calculating the enhancing parameter values depending on the reference value of the distortion indicator, the actual value of the distortion indicator and the parametric corrective transformation; deriving an instance of the corrective transformation corresponding to the enhancing parameter values from the parametric family of the corrective transformations; and applying the instance of the corrective transformation to the feature vector to provide an enhanced feature vector.

According to a third aspect of the present invention there is provided a system for enhancement of speech synthesized by a statistical text-to-speech (TTS) system employing a parametric representation of speech in a space of acoustic feature vectors, comprising: a processor; an acoustic feature vector input component for receiving an acoustic feature vector emitted by a phonetic unit; a corrective transformation defining component for defining a parametric family of corrective transformations operating in the space of the acoustic feature vectors and dependent on a set of enhancing parameters; an enhancing parametric set component including: a distortion indicator reference component for calculating a reference value of a distortion indicator attributed to a statistical model of the phonetic unit emitting the feature vector; a distortion indicator actual value component for calculating an actual value of the distortion indicator attributed to feature vectors emitted by the statistical model of the phonetic unit emitting the feature vector; and wherein the enhancing parameter set component calculating the enhancing parameter values depending on the reference value of the distortion indicator, the actual value of the distortion indicator and the parametric corrective transformation; a corrective transformation applying component for applying an instance of the corrective transformation to the feature vector to provide an enhanced feature vector.

BRIEF DESCRIPTION OF THE SEVERAL VIEWS OF THE DRAWINGS

The subject matter regarded as the invention is particularly pointed out and distinctly claimed in the concluding portion of the specification. The invention, both as to organization and method of operation, together with objects, features, and advantages thereof, may best be understood by reference to the following detailed description when read with the accompanying drawings in which:

Figure 1:
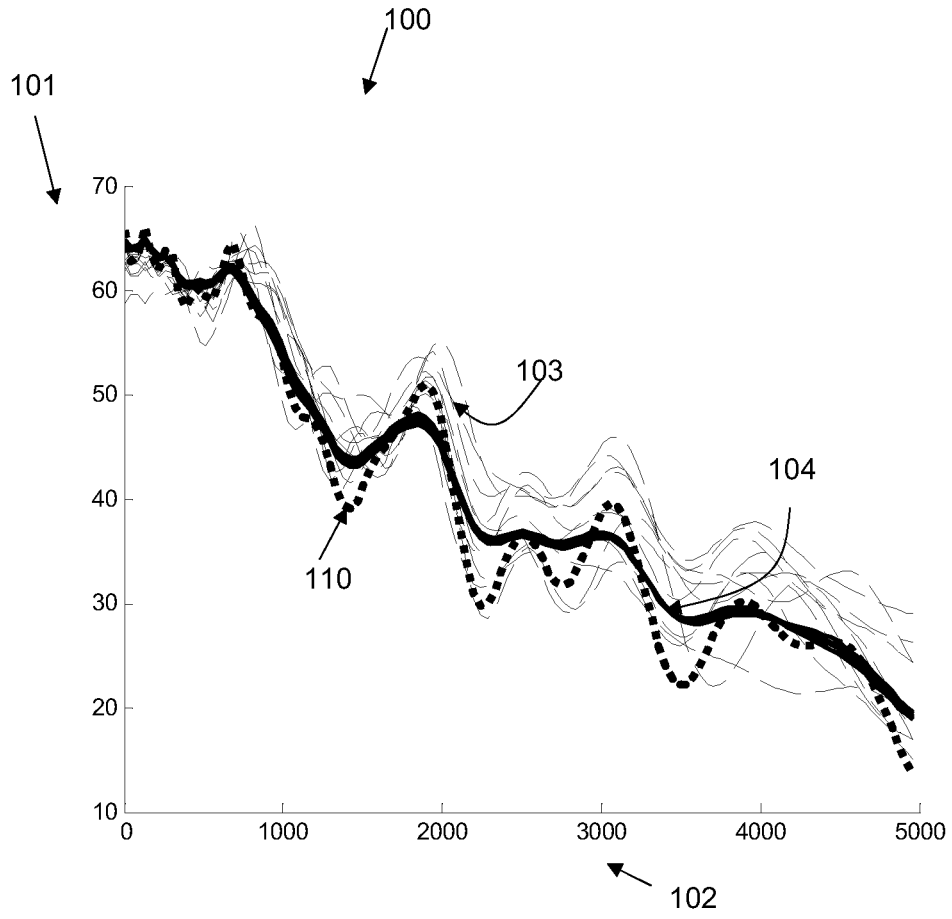
FIG. 1 is a graph showing the smearing effect of spectral envelopes derived from cepstral vectors associated with the same context-dependent phonetic unit for real and synthetic speech.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Method, system and computer program product are described in which a statistical compensation method is used on the speech output from a statistical TTS system. Distortion may be reduced in synthesized speech by compensating the spectral smearing effect inherent to statistical TTS systems and other distortions by applying a corrective transformation to acoustic feature vectors generated by the system.

In a statistical TTS system, an instantaneous spectral envelope of speech is parameterised, i.e. represented by an acoustic feature vector. In some systems the spectral envelope may combine the vocal tract and the glottal pulse related components. In this case, the influence of the glottal pulse on the spectral envelope is typically ignored, and the spectral envelope is deemed to be related to the vocal tract. In other systems, the glottal pulse and the vocal tract may be modeled and generated separately. In one embodiment used as the main example for the specific description, the method is applied to the case of a single spectral envelope. In other embodiments, the method may be applied separately to the vocal tract and glottal pulse related components.

In a statistical TTS system, a parameterized spectral envelope associated with each distinct phonetic unit is modeled by a separate probability distribution. These distinct units are usually parts of a phone taken in certain phonetic-linguistic context. For example, in a typical 3-states HMM-based system each phone taken in a certain phonetic and linguistic context is modeled by a 3-states HMM. In this case the phonetic unit represents one third (either the beginning, or the middle or the end) part of a phone taken in a context and is modeled by a multivariate Gaussian mixture probability density function. The same is true for the systems utilizing semi-Markov models (HSMM) where the state transition probabilities are not used and the unit durations are modeled directly. Other statistical TTS methods to which the described method may be applied may use models other than HMM states with emission probability modeled by probability distributions other than Gaussian.

Different types of the acoustic features may be used for the spectral envelope parameterisation in statistical TTS systems. In one embodiment used as the main example for the specific description, an acoustic feature vector in the form of a cepstral vector is used. However, other forms of acoustic feature vectors may be used, such as Line Spectral Frequencies (LSF) also referred to as Line Spectral Pairs (LSP).

In the context of cepstral features, a power cepstrum, or simply cepstrum, is the result of taking the inverse Fourier transform of the log-spectrum. In speech processing in general, and in TTS systems in particular, the frequency axis is warped prior to the cepstrum calculation. One of the popular frequency warping transformations is Mel-scale warping reflecting perceptual properties of human auditory system. The continuous spectral envelope is not available immediately from the voiced speech signal which has a quasi-periodic nature. Hence, there are a number of widely used techniques for the cepstrum estimation, each is based on a distinct method of spectral envelope estimation. Examples of such techniques are: Mel-Frequency Cepstral Coefficients (MFCC), Perceptual Linear Predictive (PLP) cepstrum, Mel-scale Regularized Cepstral Coefficients (MRCC). A finite number of the cepstrum samples (also referred to as cepstral coefficients) is calculated to form a cepstral parameters vector modeled by a certain probability distribution for each phonetic unit within a statistical TTS system.

The argument of the cepstrum signal and indices of cepstral vector components are referred to as quefrency. Cepstrum is a discrete signal, i.e. an infinite sequence of values (coefficients) c(n)=c(0), c(1), c(2), . . . n is quefrency. For example, c(2) is cepstrum value at quefrency 2. The cepstral vector used in TTS is a truncated cepstrum: V=[c1, c2, . . . , cN]. Each component has an index referred to as quefrency. For example, the c2 component is associated with quefrency 2.

The method proposed in the present invention does not exploit specific properties of Markov models or properties of Gaussian mixture models. Hence the method is applicable to any statistical TTS system that models the spectral envelope of a phonetic unit by a probability distribution defined in the space of acoustic feature vectors.

Studies and analysis presented below were carried out using a US English 5-states HSMM TTS system that employs 33-dimensional MRCC cepstral vectors for the spectral envelope parameterization. [Reference for MRCC: Shechtman, S. and Sorin, A., "Sinusoidal model parameterization for HMM-based TTS system", in Proc. Interspeech 2010.] Thus each phonetic unit is represented by a certain state of a certain HMM. The cepstral vectors associated with each unit were modeled by a distinct multivariate Gaussian probability distribution.

Once a voice model had been trained on a training sentences set, all the cepstral vectors that were clustered to a certain phonetic unit were gathered. This collection of cepstral vectors, hereafter referred to as the real cluster, were used for estimation of the unit's Gaussian mean and variance during the voice model training. All the training sentences were then synthesized and all the synthetic cepstral vectors emitted from this unit's Gaussian model were collected. This second collection is referred to as the synthetic cluster.

The over-smoothed nature of the speech generated by a statistical TTS system is due to spectral shape smearing as a result of statistical modeling of cepstral vectors (or other acoustic feature vectors) for each phonetic unit.

An example of the smearing effect is depicted in FIG. 1. FIG. 1 is a graph 100 plotting amplitude 101 against frequency 102 with spectral envelopes derived from cepstral vectors selected from the real cluster 103 and synthetic cluster 104 associated with a certain unit drawn with dashed and solid lines respectively. The synthetic vectors 104 show flatter spectra with lower peaks and higher valleys compared to the real vectors 103.

The spectrum flattening is closely related to an increased attenuation of the cepstrum with quefrency. Insight of this relation can be gained using the rational representation of the vocal tract transfer function:

$$S(z) = \frac{\prod_m (1 - z^{-1} z_m)}{\prod_k (1 - z^{-1} p_k)} \quad |p_k| < 1, |z_k| < 1 \tag{1}$$

where $\{p_k\}$ and $\{z_m\}$ are respectively poles and zeros of S(z). Taking the logarithm of the right-side of (1) and applying the Maclaurin series expansion to the additive logarithmic terms, the cepstrum of the vocal tract impulse response can be expressed as following:

$$c(n) = \frac{1}{n}\left(\sum_k p_k^n - \sum_m z_m^n\right) \quad n = 1, 2, \ldots \tag{2}$$

From (2), it follows that when the poles and zeros of the transfer function move away from the unit circle towards the origin of Z-plane—flattening spectral peaks and valleys—the cepstrum attenuation increases.

Thus it is expected that synthetic cepstral vectors associated with a certain unit have higher attenuation in quefrency than the real vectors associated with that unit. This hypothesis is supported by the statistical observations which compare the L2-norm distribution over the cepstral vector components measured on real and synthetic clusters.

Specifically, the L2-norm of a sub-vector extracted from the full 33-dimensional cepstral vector [C(1), C(2), . . . , C(33)] was calculated. Sub-vectors were analyzed containing lowest quefrency coefficients [C(1) . . . C(11)], middle quefrency coefficients [C(12) . . . C(22)] and highest quefrency coefficients [C(23) . . . C(33)]. It was seen that the L2-norm of the middle quefrency and highest quefrency sub-vectors was systematically lower within the synthetic cluster than within the real cluster. At the same time the L2-norm of the lowest quefrency sub-vectors did not vary significantly between the real and synthetic clusters.

The same phenomenon was observed in the mean values calculated over the real and synthetic clusters. For a given unit the L2-norm ratio vector R is defined as:

$$R(n) - \sqrt{M_{\text{real}}^2(n)/M_{\text{syn}}^2(n)}, n-1, \ldots, N \tag{3}$$

where $M_{real}^2$ and $M_{syn}^2$ are the component-wise empirical second moments of the real and synthetic vectors correspondingly. The second moment vectors were smoothed along the quefrency axis with the 5-tap moving average operator prior to calculating the ratio vector (3).

Figure 2:
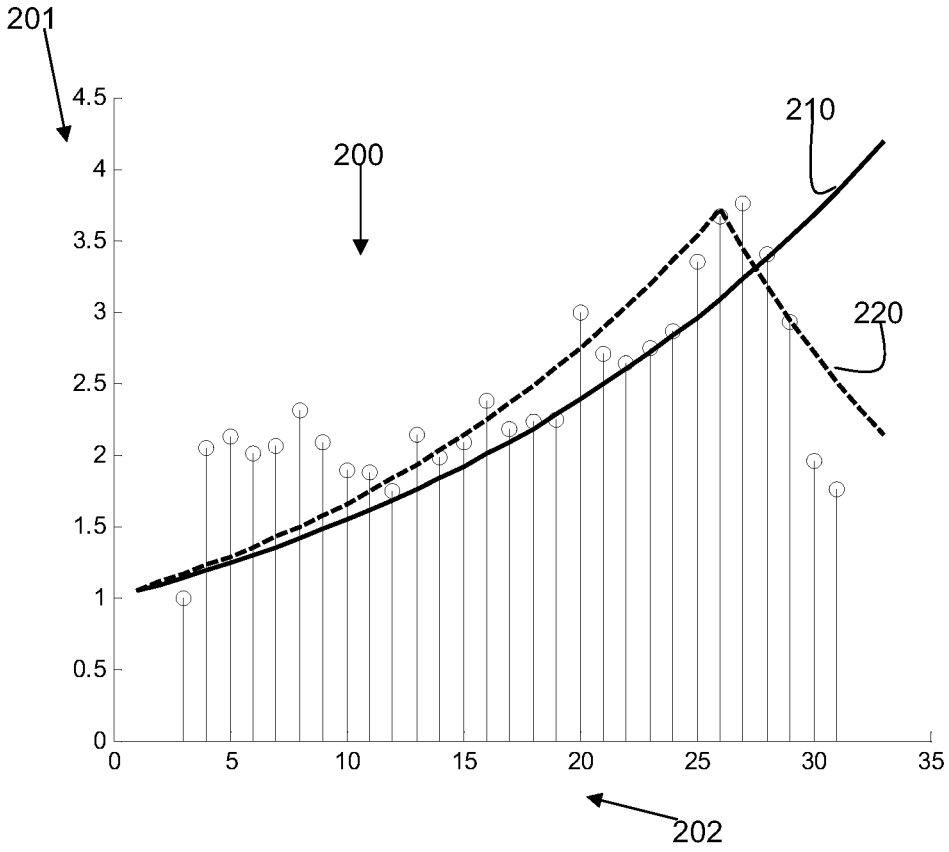
FIG. 2 is a stemmed plot of components of a ratio vector for a context-dependent phonetic unit with the components of the ratio vector plotted against quefrency.

With the reference to FIG. 2, the stemmed plot 200 represents the components of the L2-norm ratio vector R calculated for the same unit analyzed on FIG. 1 with L2-norm ratio 201 plotted against quefrency 202. The ratio vector components exhibit an increasing trend along the quefrency axis 202 which means that the synthetic vectors have a stronger attenuation than the real vectors on average. This statistical observation was validated on all the units of several male and female voice models in three languages summing up to about 7000 HMM states.

The analysis above is used to compensate for this stronger attenuation of synthetic vectors prior to rendering the synthesized speech waveform. In the above study and analysis, the attenuation of cepstrum coefficients in quefrency is considered. Other indications of acoustic distortion may be used for other forms of acoustic feature vectors, such as Line Spectral Frequencies. The distortion indicator may indicate (or enable a derivation of) a degree of spectral smoothness or other spectral distortion.

In an example embodiment of the described method, the compensation transformation is represented as component-wise multiplication, referred to as liftering, of a distorted synthetic cepstral vector C=[C(1), . . . , C(N)] by a corrective vector W=[W(1), . . . , W(N)] with positive components. Then the enhanced output vector O is:

$$O = C \otimes W \square [O(n) = C(n) \cdot W(n), n = \overline{1, N}] \tag{4}$$

Hereafter a dual treatment of the corrective vector is adopted. On one hand it is considered a vector, i.e. an ordered set of values. On the other hand it is considered as a result of sampling of function W(n) at the grid n=[1, 2, . . . , N].

The observations described above suggest that the corrective liftering function W(n) in general should be increasing in n though not necessarily monotonously. Two requirements may be imposed on the corrective function in order to prevent audible distortions in the enhanced synthesized speech:

- The form of the liftering function may be chosen so that the frequencies of spectral peaks and valleys do not change significantly as a result of the liftering operation. In particular it means that the liftering function should be smooth in quefrency.
- The degree of spectrum sharpness achieved by the corrective liftering operation may be within the range observed in the real cluster associated with the corresponding phonetic unit.

The general idea of the described method is to define a parametric family of smooth positive corrective functions $W_p(n)$ (e.g. exponential) dependant on a parameters set p and to calculate the parameter values either for each phonetic unit or for each emitted cepstral vector so that the cepstral attenuation degree (and corresponding spectral sharpness degree) after the liftering matches the average level observed in the corresponding real cluster.

The described method statistically controls the corrective liftering to greatly improve the quality of synthesized speech while preventing an over-liftering introducing audible distortions.

Description of the Proposed Method

Let: $W_p(n)$ be a parametric family of corrective liftering functions dependant on enhancing parameters set p; C=[C(n), n=1, . . . , N] be a synthetic cepstral vector emitted from a phonetic unit model L of a statistical TTS system; and H(X) be a vectorial function of a cepstral vector X indicative of its attenuation. Hereafter H(X) is referred to as attenuation indicator.

A reference value $H_{real}$ of the attenuation indicator may be calculated for the unit L by averaging of H(X) over the real cluster associated with that unit:

$$H_{real}=E\{H(X),X\in\text{raw cluster } L\} \tag{5}$$

An actual value $H_{syn}$ of the attenuation indicator may be calculated by averaging of H(X) over the synthetic cluster created in advance for the unit L:

$$H_{syn}=E\{H(X),X\in\text{synthetic cluster } L\} \tag{6.1}$$

Alternatively the actual value $H_{syn}$ may be calculated from the same single synthetic vector C to be processed:

$$H_{syn}=H(C) \tag{6.2}$$

Optimal values of the enhancing parameters may be calculated that provide the best approximation of the reference value of the attenuation indicator:

$$p^{opt}=p^{opt}(H_{real},H_{syn})=\underset{p}{\operatorname{argmin}}D(H_{real},H_{syn},W_p) \tag{7}$$

where $D(H_{real}, H_{syn}, W_p)$ is an enhancement criterion that measures a dissimilarity between the reference value of the attenuation indicator and a predicted actual value of the attenuation indicator after applying the corrective liftering $W_p$.

Finally, the optimal liftering may be applied to vector C yielding the enhanced vector O:

$$O=W_p^{opt}\otimes C=[W_p^{opt}(n)\cdot C(n),n=1,\ldots,N] \tag{8}$$

which may be used further for the output speech waveform rendering according to the regular scheme adopted for the original statistical TTS system.

The process described above may be applied to each cepstral vector output from the original statistical TTS system.

Referring to the calculation of the actual value $H_{syn}$ of the attenuation indicator given by the two alternative formulas (6.1) and (6.2), it can be noted that the alternative choices yield similar results. This may be explained by the fact that in HMM TTS systems synthetic clusters exhibit low variance, and therefore each vector, e.g. C, is close to the cluster's average. However, (6.1) and (6.2) lead to two different modes of operation of the enhanced system.

In the first case (6.1), the optimal enhancing parameters set p and the corrective liftering vector $W_p$ associated with each unit may be calculated off-line prior to exploitation of the enhanced system and stored. In the synthesis time, the corresponding pre-stored liftering function may be applied to each synthetic vector C. This choice simplifies the implementation of the run-time component of the enhanced system.

In the second case (6.2), the calculation of the optimal corrective liftering vector $W_p$ may be performed for each vector C emitted from the statistical model in run-time. Only the reference values $H_{real}$ may be calculated off-line and stored. In the synthesis time the reference value $H_{real}$ associated with the corresponding unit may be passed to the enhancement algorithm. This choice removes the need to build the synthetic clusters for each unit. Moreover, with a proper selection of the attenuation indicator H(X), as described below, there is no need to store $H_{real}$ vectors. Instead they are easily derived from the statistical model parameters, and the proposed method may be applied to pre-existing voice models built for the original TTS system.

The method described above in general terms will be better understood with reference to following example embodiments addressing specific important points of the algorithm.

Choice of the Corrective Liftering Function Family.

Relation (2) suggests a simple and mathematically tractable exponential corrective function:

$$W_\alpha(n)=\alpha^n,\alpha>1 \tag{9}$$

in which case the enhancing parameter set p may be comprised of a single scalar exponent base α. Within the pole-zero model (2), the exponential liftering results in the uniform radial migration of poles and zeros towards the unit circle of the complex plane that directly relates to spectrum sharpening without changing the location of the peaks and valleys on the frequency axis:

$$O(n)=\alpha^n\cdot C(n)=\frac{1}{n}\left(\sum_k(\alpha p_k)^n-\sum_m(\alpha z_m)^n\right), \tag{10}$$

$$1<\alpha<1/\max(|p_k|,|z_m|)$$

The degree of the spectrum sharpening depends on the selected exponent base α value. A too high α may overemphasize the spectral formants and even render the inverse cepstrum transform unstable. On the other hand, a too low α may not yield the expected enhancement effect. This is why the statistical control over the liftering parameters is important.

A study of typical shapes of the L2-norm ratio vectors (exemplified by the stemmed plot on FIG. 2) motivated an alternative, less tractable mathematically, corrective function in the form of two concatenated exponents:

$$W_{\alpha,\beta,\gamma}(n) = \begin{cases} \alpha^n, & 1 \le n \le \gamma \\ \alpha^{\gamma} \cdot b^{(n-\gamma)}, & \gamma < n \le N \end{cases} \tag{11}$$

In this case the enhancing parameters set may be comprised of three parameters: the base $\alpha$ of the first exponent, the base $\beta$ of the second exponent and integer concatenation point $\gamma$, i.e. the index of the vector component where the concatenation takes place.

Choice of the Attenuation Indicator H(X)

The embodiments of the proposed method described below may be based on the attenuation indicator defined as:

$$H(X)=[X^2(n), n=1, \ldots, N] \tag{12}$$

Then the reference value $H_{real}$ given by (5) is the second moment $M_{real}^2$ of the real cluster associated with the phonetic unit L. Practically there is no need to build the real cluster in order to calculate the vector $M_{real}^2$. In many cases it can be easily calculated from the cepstral vectors probability distribution. For example, in the case of Gaussian mixture models used in HMM TTS systems, the reference value may be calculated as:

$$M_{real}^2(n) = \sum_{i=1}^{I} \lambda_i \cdot [\sigma_i^2(n) + \mu_i^2(n)] \quad n = \overline{1, N} \tag{13}$$

where $\mu_i$, $\sigma_i^2$ and $\lambda_i$ are respectively mean-vectors, variance-vectors and weights associated with individual Gaussians.

The actual value $H_{syn}$ of the attenuation indicator may be either the empirical second moment of the cepstral vectors calculated over the synthetic cluster or squared vector C to be enhanced depending on the choice between (6.1) and (6.2).

The components of the vectors $H_{real}$ and $H_{syn}$ may be optionally smoothed by a short filter such as 5-tap moving average filter. Hereafter, the smoothed versions of the vectors retain the same notations to avoid complication of the formulas.

Choice of the Enhancement Criterion

In one embodiment of the proposed method, the enhancement criterion $D(H_{real}, H_{syn}, W_p)$ appearing in (7) may be defined as:

$$D(H_{real}, H_{syn}, W_p) = \sum_n \left\{\log\left[W_p(n) \cdot \sqrt{H_{syn}(n)}\right] - \log\sqrt{H_{real}(n)}\right\}^2 \tag{14}$$

When H(X) is defined by (12), the enhancement criterion (14) represents a dissimilarity between the corrective vector $W_p$ and the L2-norm ratio vector $R=[\sqrt{M_{real}^2(n)/H_{syn}(n)}, n=1, \ldots, N]$, or in other words the enhancement criterion represents a predicted flatness of the L2-norm ratio vector after applying the enhancement.

In another embodiment, the enhancement criterion may be defined as:

$$D(H_{real}, H_{syn}, W_p) = \left|\sum_n n^2 W_p^2(n) H_{syn}(n) - \sum_n n^2 H_{real}(n)\right| \tag{15}$$

Note that when H(X) is defined by (12)

$$\sum_n n^2 H(n) = \sum_n n^2 X^2(n) = Const. \int_0^{\pi} \left(\frac{d(\log S(\omega))}{d\omega}\right)^2 d\omega \tag{16}$$

where $S(\omega)$ is spectral envelope corresponding to the cepstral vector X. Hence the enhancement criterion (15) predicts the dissimilarity between the real and enhanced synthetic vectors in terms of spectrum smoothness.

Calculation of the Optimal Enhancing Parameters

EXAMPLE 1

In the case of the exponential corrective liftering function (9) and the enhancement criterion (14), the calculation (7) of the optimal enhancing parameter a may be achieved by log-linear regression:

$$\log\alpha^{opt} = \sum_n n \cdot \log R(n) \Big/ \sum_n n^2 \tag{17}$$

$$R(n) = \sqrt{M_{real}^2(n) / H_{syn}(n)}$$

Referring to the FIG. 2, an example of the optimal corrective liftering function calculated according to (17) is drawn by the bold solid line 210. An enhanced spectral envelope resulting from the corrective liftering is shown on FIG. 1 by the dashed bold line 110. It can be seen that the enhanced spectral envelope exhibits emphasized peaks and valleys and resembles the real spectra much better compared to the original synthetic spectra.

EXAMPLE 2

In the case of two-concatenated exponents (11) and the enhancement criterion (14), the optimal set of the enhancing parameters may be calculated as follows. Fixing the concatenation point $\gamma$, the values of $\alpha$ and $\beta$ may be calculated as:

$$\log\alpha(\gamma) = \sum_{n \le \gamma} n \cdot \log R(n) \Big/ \sum_{n \le \gamma} n^2 \tag{18}$$

$$\log\beta(\gamma) = \sum_{n > \gamma} (n-\gamma) \cdot (\log R(n) - \gamma \log\alpha(\gamma)) \Big/ \sum_{n > \gamma} (n-\gamma)^2$$

Then the optimal values of the three parameters may be obtained by scanning all the integer values of $\gamma$ within a predefined range:

$$\gamma^{opt} = \underset{\gamma \in [min\gamma, max\gamma]}{\operatorname{argmin}} D(M_{real}^2, H_{syn}, W_{\alpha(\gamma),\beta(\gamma),\gamma}) \tag{19}$$

$$\log\alpha^{opt} = \log\alpha(\gamma^{opt})$$

$$\log\beta^{opt} = \log\beta(\gamma^{opt})$$

with $1<min\gamma<max\gamma<N$ such as for example $min\ \gamma=0.5*N$ and $max\ \gamma=0.75*N$.

An example of the optimal corrective liftering function calculated according to (18) and (19) is drawn on FIG. 2 by the bold dashed line 220.

EXAMPLE 3

In the case of the exponential corrective liftering function (9) and enhancement criterion (15), the optimal value of the exponent base $\alpha$ may be obtained by solving following equation:

$$\sum_n \alpha^{2n} \cdot n^2 \cdot H_{syn}(n) = \sum_n n^2 \cdot M_{real}^2(n),\ \alpha > 0 \tag{20}$$

The left-side of (20) is an unlimited monotonously increasing function of a which is less than the right-side value for $\alpha=0$. Therefore the equation has a unique solution and can be solved numerically by one of the methods known in the art.

Customization of the Enhancing Parameters

The optimal enhancing parameters bring the attenuation degree of the synthetic cepstral vectors to the averaged level observed on the corresponding real cluster. Therefore, the enhancement may be strengthened or softened to some extent relatively to the optimal level in order to optimize the perceptual quality of the enhanced synthesized speech. In some embodiments of the proposed method, the optimal enhancing parameters calculated as described above may be altered depending on certain properties of the corresponding phonetic units emitting the synthetic vectors to be enhanced. For example, the optimal exponent base (17) calculated for vectors emitted from a certain unit of an HMM TTS system may be modified as:

$$\alpha_{final}=1+(\alpha_{opt}-1)\cdot F(\text{state_number,phone,voicing_class}) \tag{21}$$

where a predefined factor F depends on the HMM state number representing that unit, a category of the phone represented by this HMM and voicing class of the segments represented by this state. For example F(3,"AH",1)=1.2 means that the enhancement will be strengthened roughly by 20% relatively to the optimal level for all the units representing state number 3 of the phone "AH" given that the majority of frames clustered to this unit are voiced.

Then the final value $\alpha_{final}$ may be used for rendering the corrective liftering vector to be applied to the corresponding synthetic cepstral vector.

Figure 3:
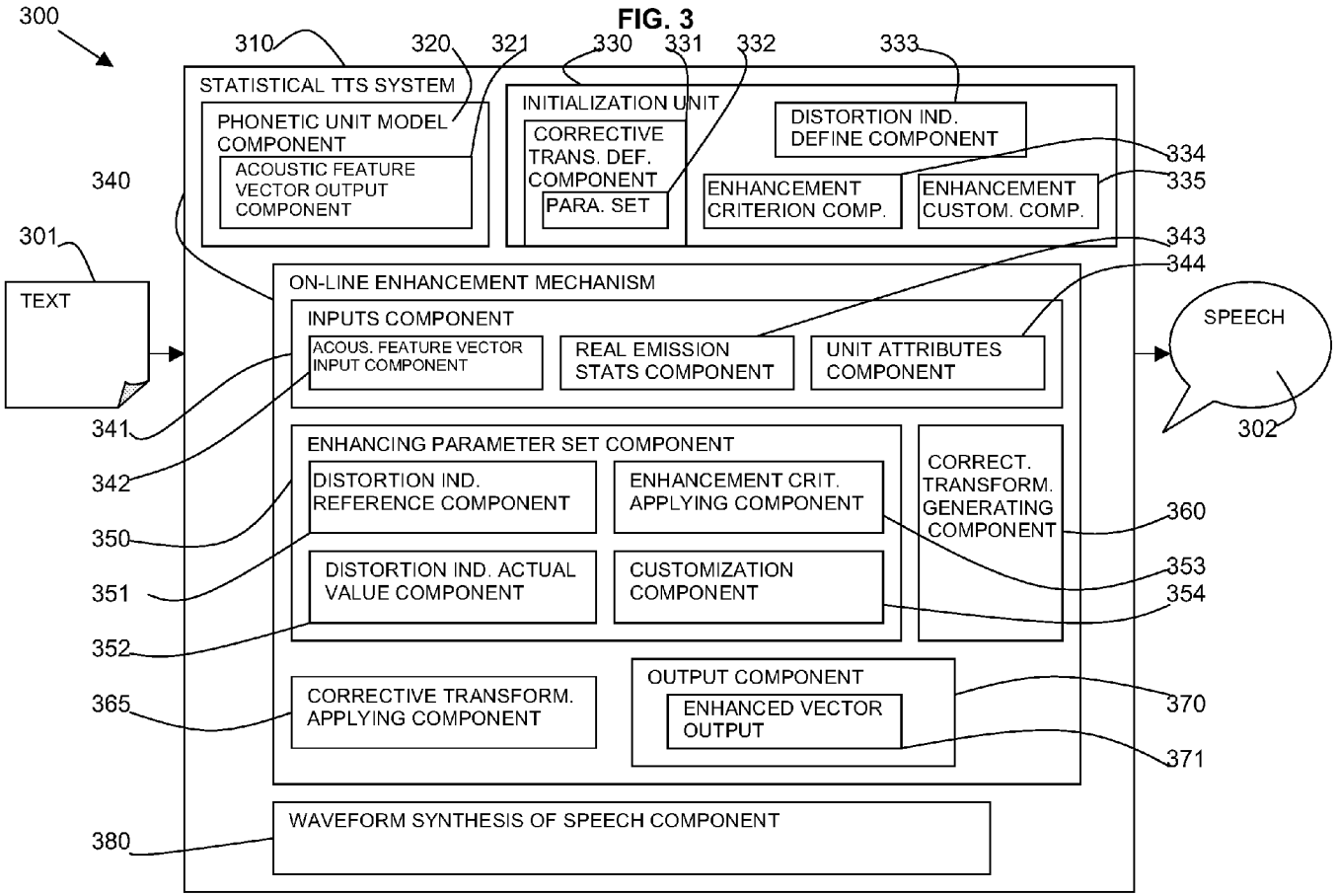
FIG. 3 is a block diagram of a first embodiment of a system in accordance with the present invention.
Figure 4:
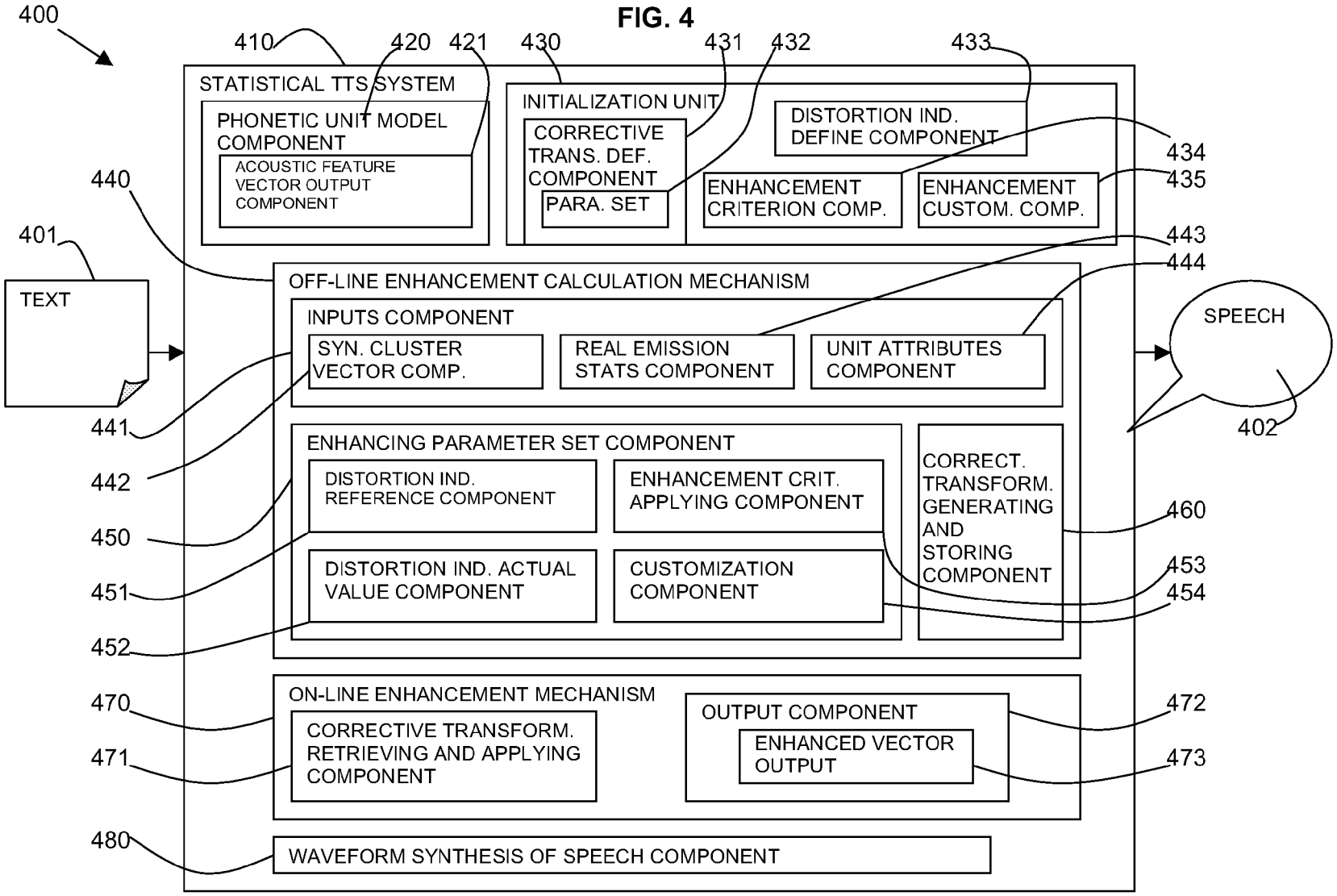
FIG. 4 is a block diagram of a second embodiment of a system in accordance with the present invention.

Referring to FIGS. 3 and 4, block diagrams show example embodiments of a system 300, 400 in which the described statistical enhancement of synthesized speech is applied.

Referring to FIG. 3, the system 300 includes an on-line enhancement mechanism 340 for a statistical TTS system 310. The system 300 includes a statistical TTS system 310, for example, an HMM-based system which receives a text input 301 and synthesizes the text to provide a speech output 302.

In one embodiment, TTS system 310 is an HMM-based system which models parameterised speech by a sequence of Markovian processes with unobserved (hidden) states with Gaussian mixture emitting probability distribution. In other embodiments, other forms of statistical modeling may be used.

The statistical TTS system 310 may include a phonetic unit model component 320 including an acoustic feature vector output component 321 for outputting synthetic acoustic feature vectors generated out of this unit model. In one embodiment, the acoustic feature vector may be a cepstral vector. In another embodiment, the acoustic feature vector may be a Line Spectral Frequencies vector.

An initialization unit 330 may be provided including a corrective transformation defining component 331 for defining the parametric corrective transformation to be used for the corrective transformation instance derivation. The corrective transformation defining component 331 may also include an enhancing parameter set component 332 for defining the enhancing parameter set to be used. The initialization unit 330 may also include a distortion indicator component 333 for defining a distortion indicator to be used and an enhancement criterion component 334 for defining an enhancement criterion to be used. The initialization unit 330 may also include an enhancement customization component 335 dependent on unit attributes and enhancing parameters. In the embodiment of the acoustic feature vector being a cepstral vector, the distortion indicator is an attenuation indicator.

An on-line enhancement mechanism 340 is provided which may include the following components for enhancing distorted acoustic feature vectors as output by the phonetic unit model component 320 by applying an instance of the corrective transformation.

The on-line enhancement mechanism 340 may include an inputs component 341. The inputs component 341 may include an acoustic feature vector input component 342 for receiving outputs from the phonetic unit model component 320. For example, a sequence of N-dimensional cepstral vectors.

The inputs component 341 may also include a real emission statistics component 343 for receiving real emission statistics from the statistical model of the phonetic unit model component 320.

The inputs component 341 may also include a unit attributes component 344 for receiving unit attributes of the phonetic unit model component 320.

The on-line enhancement mechanism 340 may also include an enhancing parameter set component 350. The enhancing parameter set component 350 may include a distortion indicator reference component 351 and a distortion indicator actual value component 352 for applying the distortion indicator definitions and calculating the actual and reference values for use in the enhancing parameter set derivation.

The enhancing parameter set component 350 may also include an enhancement criterion applying component 353 for applying a defined enhancement criterion to measure the dissimilarity between the reference value of the distortion indicator and a predicted actual value.

The enhancing parameter set component 350 may include a customization component 354 for altering optimal enhancing parameter set values according to unit attributes. The attributes may include a phone category which the statistical model is attributed to and voicing class of the majority of speech frames used for the statistical model training.

The on-line enhancement mechanism 340 may include a corrective transformation generating component 360 and a corrective transformation applying component 365 for applying an instance of the parametric transformation derived from the enhancing parameter set values to an acoustic feature vector yielding an enhanced vector.

The on-line enhancement mechanism 340 may include an output component 370 for outputting the enhanced vector output 371 for use in a waveform synthesis of the speech component 380 of the statistical TTS system 310.

Referring to FIG. 4, the system 400 shows an alternative embodiment to that of FIG. 3 in which the corrective transformation is generated off-line. Equivalent reference numbers to FIG. 3 are used where possible.

As in FIG. 3, the system 400 includes a statistical TTS system 410, for example, an HMM-based system which receives a text input 401 and synthesizes the text to provide a speech output 402. The statistical TTS system 410 may include a phonetic unit model component 420 including an acoustic feature vector output component 421 for outputting synthetic acoustic feature vectors generated out of this unit model.

As in FIG. 3, an initialization unit 430 may be provided including a corrective transformation defining component 431 for defining the parametric corrective transformation to be used for the corrective transformation instance derivation. The corrective transformation defining component 431 may also include a parameter set component 432 for defining the enhancing parameter set to be used. The initialization unit 430 may also include a distortion indicator component 433 for defining a distortion indicator to be used and an enhancement criterion component 434 for defining an enhancement criterion to be used. The initialization unit 430 may also include an enhancement customization component 435 dependent on unit attributes and enhancing parameters.

In this embodiment, an off-line enhancement calculation mechanism 440 may be provided for generating and storing a corrective transformation instance. An on-line enhancement mechanism 450 may be provided to retrieve and apply instances of the corrective transformation during speech synthesis.

The off-line enhancement calculation mechanism 440 may include an inputs component 441. The inputs component 441 may include a synthetic cluster vector component 442 for collecting a synthetic cluster of acoustic feature vectors for each phonetic unit emitted from the phonetic unit model component 420. The inputs component 441 may also include a real emission statistics component 443 for receiving real emission statistics from the statistical model of the phonetic unit model component 420. The inputs component 441 may also include a unit attributes component 444 for receiving unit attributes of the phonetic unit model component 420.

The off-line enhancement calculation mechanism 440 may also include an enhancing parameter set component 450. The enhancing parameter set component 450 may include a distortion indicator reference component 451 and a distortion indicator actual value component 452 for applying the distortion indicator definitions and calculating the actual and reference values for use in the enhancing parameter set derivation. The enhancing parameter set component 450 may also include an enhancement criterion applying component 453 for applying a defined enhancement criterion to measure the dissimilarity between the reference value of the distortion indicator and a predicted actual value. The enhancing parameter set component 450 may include a customization component 454 for altering optimal enhancing parameter set values according to unit attributes.

The off-line enhancement calculation mechanism 440 may include a corrective transformation generating and storing component 460.

The on-line enhancement mechanism 470 may include a corrective transformation retrieving and applying component 471 for applying the instance of the parametric corrective transformation derived from the enhancing parameter set values to an acoustic feature vector yielding an enhanced vector. The on-line enhancement mechanism 470 may include an output component 472 for outputting the enhanced vector output 473 for use in a waveform synthesis of the speech component 480 of the statistical TTS system 410.

Figure 5:
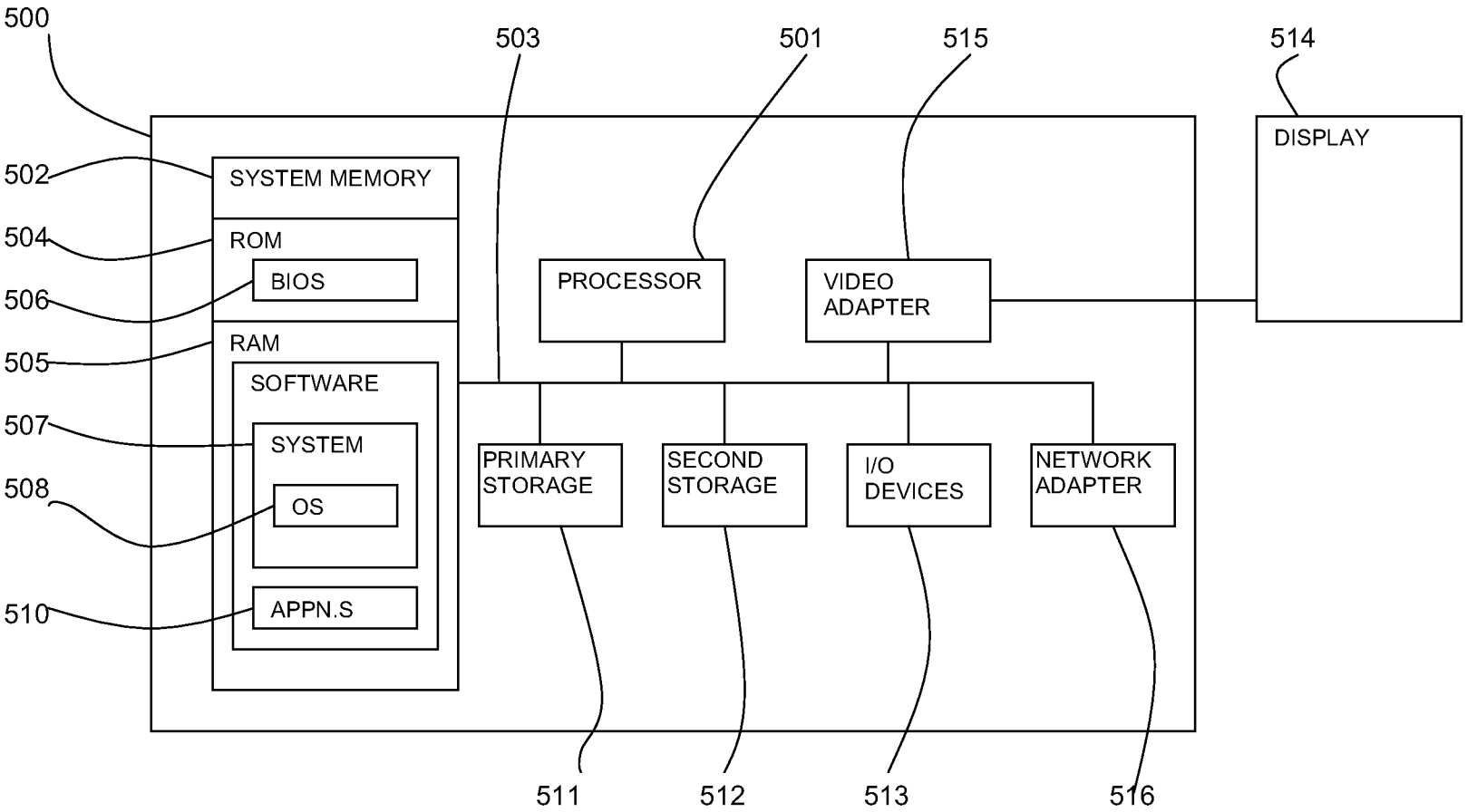
FIG. 5 is a block diagram of a computer system in which the present invention may be implemented.

Referring to FIG. 5, an exemplary system for implementing aspects of the invention includes a data processing system 500 suitable for storing and/or executing program code including at least one processor 501 coupled directly or indirectly to memory elements through a bus system 503. The memory elements can include local memory employed during actual execution of the program code, bulk storage, and cache memories which provide temporary storage of at least some program code in order to reduce the number of times code must be retrieved from bulk storage during execution.

The memory elements may include system memory 502 in the form of read only memory (ROM) 504 and random access memory (RAM) 505. A basic input/output system (BIOS) 506 may be stored in ROM 504. System software 507 may be stored in RAM 505 including operating system software 508. Software applications 510 may also be stored in RAM 505.

The system 500 may also include a primary storage means 511 such as a magnetic hard disk drive and secondary storage means 512 such as a magnetic disc drive and an optical disc drive. The drives and their associated computer-readable media provide non-volatile storage of computer-executable instructions, data structures, program modules and other data for the system 500. Software applications may be stored on the primary and secondary storage means 511, 512 as well as the system memory 502.

The computing system 500 may operate in a networked environment using logical connections to one or more remote computers via a network adapter 516.

Input/output devices 513 can be coupled to the system either directly or through intervening I/O controllers. A user may enter commands and information into the system 500 through input devices such as a keyboard, pointing device, or other input devices (for example, microphone, joy stick, game pad, satellite dish, scanner, or the like). Output devices may include speakers, printers, etc. A display device 514 is also connected to system bus 503 via an interface, such as video adapter 515.

Figure 6:
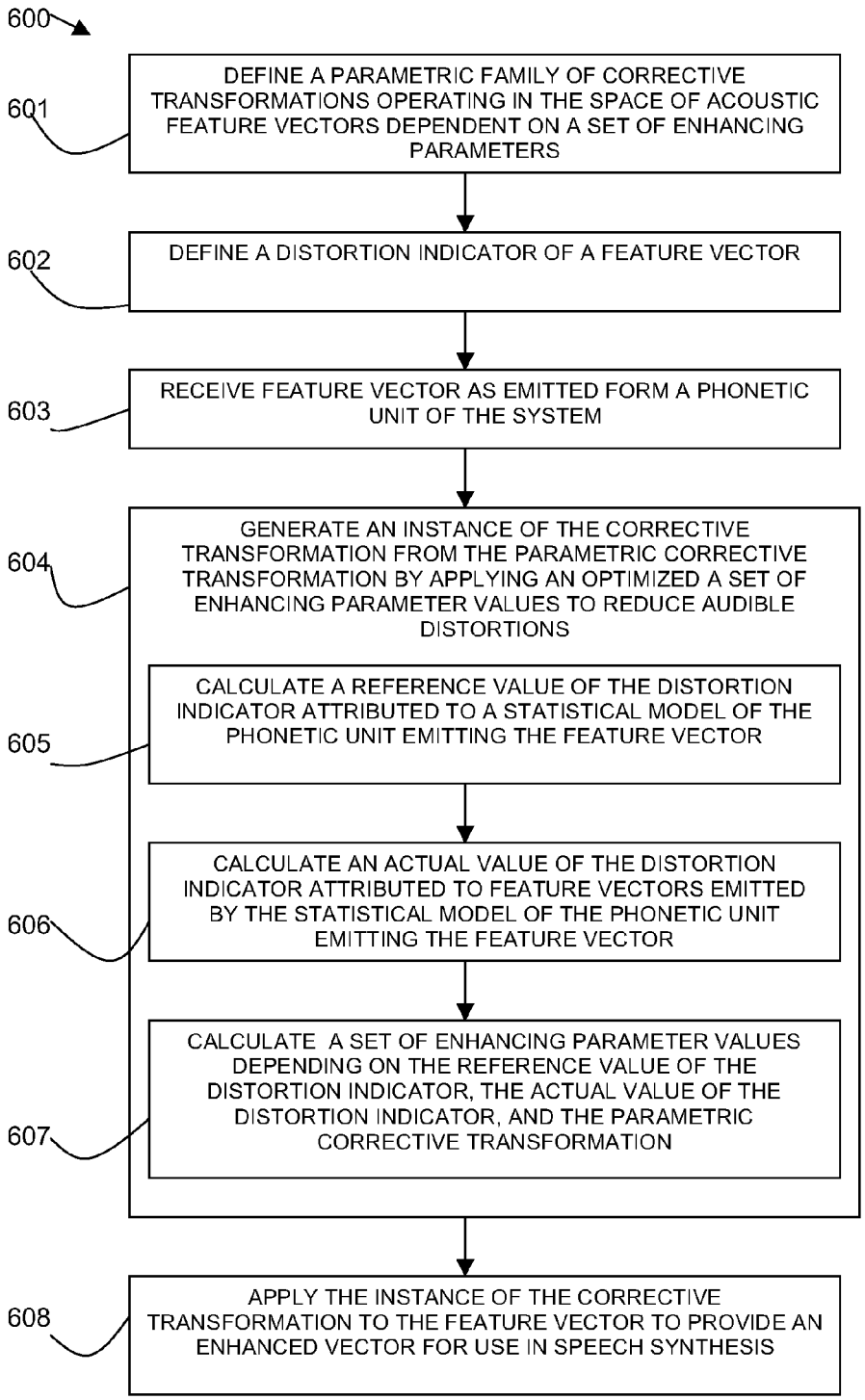
FIG. 6 is a flow diagram of a method in accordance with the present invention.

Referring to FIG. 6, a flow diagram 600 shows the described method. A parametric family of corrective transformations is defined 601 operating in the space of acoustic feature vectors and dependent on a set of enhancing parameters. A distortion indicator of a feature vector may also be defined 602. A feature vector is received 603 as emitted form a phonetic unit of the system. An instance of the corrective transformation may be generated 604 from the parametric corrective transformation by applying an optimized a set of enhancing parameter values to reduce audible distortions.

The instance of the corrective transformation may be generated by the following steps. Calculating 605 a reference value of the distortion indicator attributed to a statistical model of the phonetic unit emitting the feature vector, and calculating 606 an actual value of the distortion indicator attributed to feature vectors emitted by the statistical model of the phonetic unit emitting the feature vector, and calculating 607 a set of enhancing parameter values depending on the reference value of the distortion indicator, the actual value of the distortion indicator, and the parametric corrective transformation.

The instance of the corrective transformation may be applied 608 to the feature vector to provide an enhanced vector for use in speech synthesis.

Figure 7:
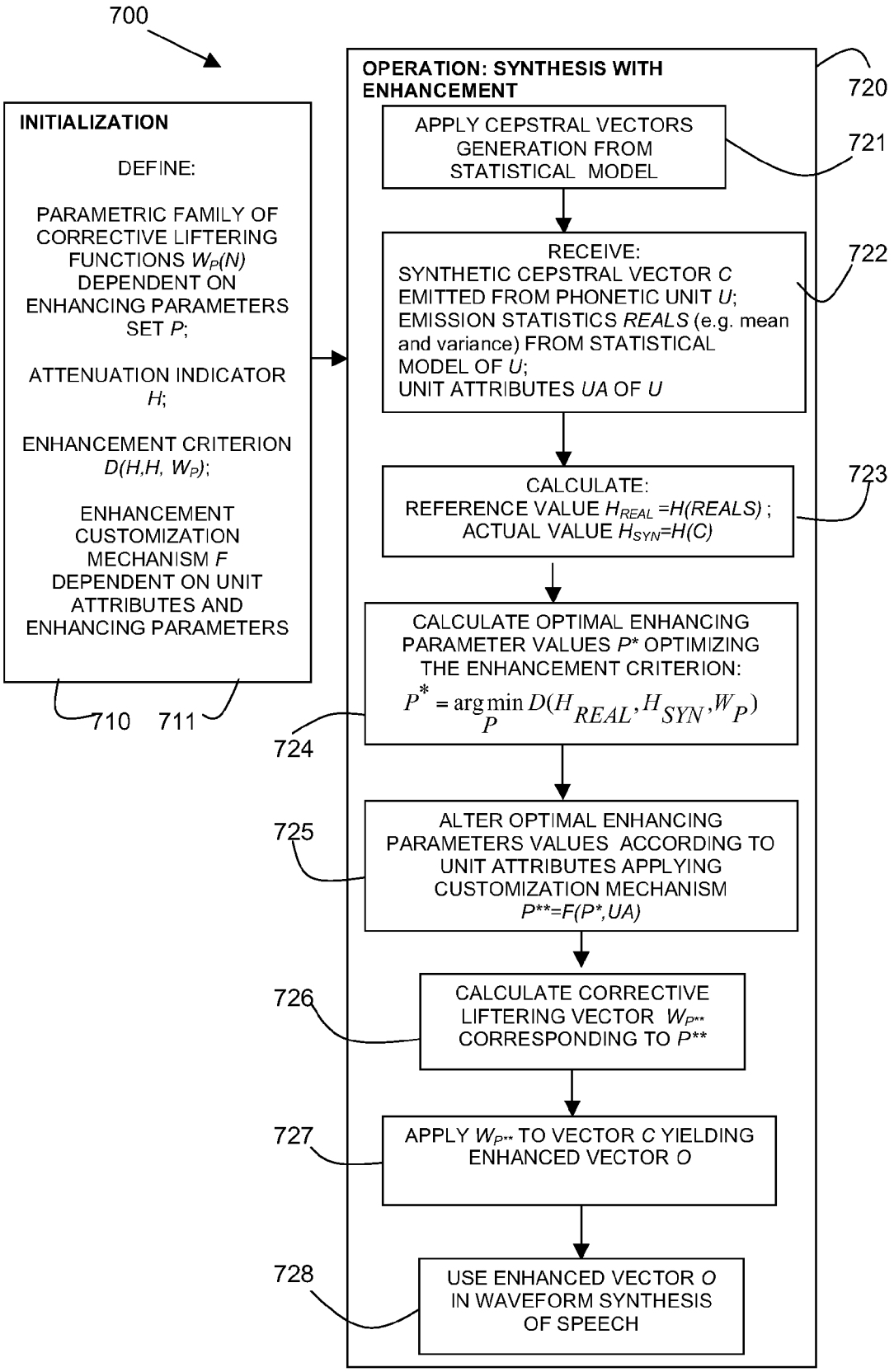
FIG. 7 is a flow diagram of a first embodiment of a method in accordance with the present invention applied in an on-line operational mode.
Figure 8:
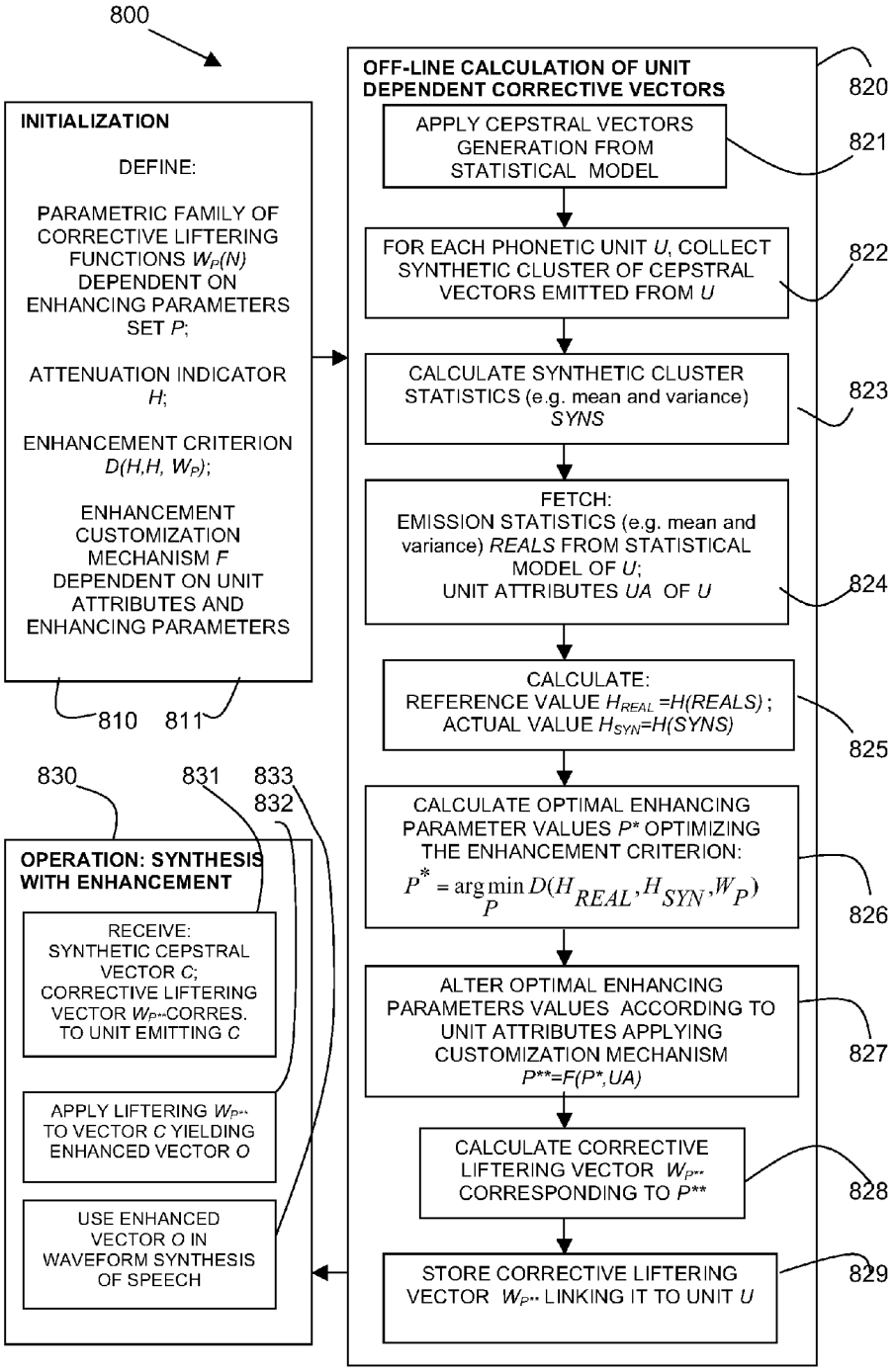
FIG. 8 is a flow diagram of a second embodiment of a method in accordance with the present invention applied in an off-line/on-line operational mode.

Referring to FIGS. 7 and 8, flow diagrams 700, 800 show example embodiments of the described method in the context of corrective liftering vectors applied to cepstral vectors with distortion indicators in the form of attenuation indicators for smoothing spectral distortion.

Referring to FIG. 7, a flow diagram 700 shows steps of an example embodiment of the described method corresponding to the case where cepstral acoustic feature vectors and liftering corrective transformation are used and the corrective liftering vectors are calculated on-line during the synthesis operation.

A first initialization phase 710 may include defining 711: parametric family of corrective liftering functions $W_P(N)$ dependent on enhancing parameter set P; attenuation indicator H; enhancement criterion $D(H, H, W_P)$; and enhancement customization mechanism F dependent on unit attributes and enhancing parameters.

A second phase 720 is the operation of synthesis with enhancement. Cepstral vector generation may be applied 721 from the statistical model. The following may be received 722: synthetic cepstral vector C emitted from phonetic unit U; emission statistics REALS (e.g. mean and variance) from statistical model of U; and unit attributes UA of phonetic unit U.

A reference value of the attenuation indictor may be calculated $H_{REAL}$=H(REALS) as well as an actual value $H_{SYN}$=H (C) 723. Optimal enhancing parameter values P* may be calculated 724 optimizing the enhancement criterion:

$$P^* = \underset{P}{\operatorname{argmin}} D(H_{REAL}, H_{SYN}, W_P).$$

The optimal enhancing parameter values may be altered 725 according to unit attributes applying customization mechanism P**=F(P*,UA). A corrective liftering vector $W_{P}$ corresponding to P may be calculated 726 and applied 727 to vector C yielding enhanced vector O. The enhanced vector O may be used 728 in waveform synthesis of speech Referring to FIG. 8, a flow diagram 800 shows steps of an example embodiment of the described method corresponding to the case where cepstral acoustic feature vectors and liftering corrective transformation are used and the corrective liftering vectors are calculated off-line and stored being linked to corresponding phonetic units.

A first initialization phase 810 may include defining: parametric family of corrective liftering functions $W_P(N)$ dependent on enhancing parameter set P; attenuation indicator H; enhancement criterion $D(H, H, W_P)$; and enhancement customization mechanism F dependent on unit attributes and enhancing parameters.

A second phase 820 is an off-line calculation of unit dependent corrective vectors. Cepstral vector generation may be applied 821 from the statistical model. For each phonetic unit U, a synthetic cluster of cepstral vectors emitted from phonetic unit U may be collected 822. The synthetic cluster statistics (e.g. means and variance) SYNS may be calculated 823. The emission statistics (e.g. mean and variance) REALS may be fetched 824 from statistical model of U together with the unit attributes UA of phonetic model U.

A reference value of attenuation indicator may be calculated $H_{REAL}$=H(REALS) as well as the actual value $H_{SYN}$=H (SYNS) 825. Optimal enhancing parameter values P* may be calculated 826 optimising the enhancement criterion:

$$P^* = \underset{P}{\operatorname{argmin}} D(H_{REAL}, H_{SYN}, W_P).$$

The optimal enhancing parameter values may be altered 827 according to unit attributes applying customization mechanism P**=F(P*,UA).

The corrective liftering vector $W_{P}$ corresponding to P is calculated 828. The liftering vector $W_{P**}$ is stored 829 being linked to the unit U.

At an on-line operation 830 of synthesis with enhancement, a synthetic cepstral vector C is received 831 together with a corrective liftering vector $W_{P}$ corresponding to unit emitting C. Corrective liftering vector $W_{P}$ is applied 832 to vector C yielding enhanced vector O. The enhanced vector O is used 833 in waveform synthesis of speech.

The enhancement method described improves the perceptual quality of synthesized speech by strong reduction of the spectral smearing effect. The effect of this enhancement technique consists of moving poles and zeros of the transfer function corresponding to the synthesized spectral envelope towards the unit circle of Z-plane which leads to sharpening of spectral peaks and valleys.

It is applicable to a wide class of HMM-based TTS systems and of statistical TTS systems in general. Most HMM TTS systems model frames' spectral envelopes in the cepstral space i.e. use cepstral feature vectors. The enhancement technique described works in the cepstral domain and is directly applicable to any statistical system employing cepstral features.

The described method does not introduce audible distortions due to the fact that it works adaptively exploiting statistical information available within a statistical TTS system. The corrective transformation applied to a synthetic vector output from the original TTS system is calculated with the goal to bring the value of certain characteristics of the enhanced vector to the average level of this characteristic observed on relevant feature vectors derived from real speech.

The described method does not require building of a new voice model. The described method can be employed with a pre-existing voice model. The real vectors statistics used as a reference for the corrective transformation calculation can be calculated based on the cepstral mean and variance vectors readily available within the existing voice model.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention claimed is:

1. A method for enhancement of speech synthesized by a statistical text-to-speech (TTS) system employing a parametric representation of short-time spectral envelope of speech in a space of acoustic feature vectors, comprising:

defining a parametric family of corrective transformations operating in the space of the acoustic feature vectors and dependent on a set of enhancing parameters, wherein number of the enhancing parameters in the set of enhancing parameters is less than a dimension of the space of the acoustic feature vectors;

defining a distortion indicator of a feature vector or a plurality of feature vectors, wherein the distortion indicator is not modelled directly by the statistical TTS system;

receiving a feature vector output by the system;

generating an instance of the corrective transformation by:

calculating a reference value of the distortion indicator attributed to a statistical model of the phonetic unit emitting the feature vector;

calculating an actual value of the distortion indicator attributed to feature vectors emitted by the statistical model of the phonetic unit emitting the feature vector;

calculating the enhancing parameter values depending on the reference value of the distortion indicator, the actual value of the distortion indicator and the parametric corrective transformation;

deriving an instance of the corrective transformation corresponding to the enhancing parameter values from the parametric family of the corrective transformations; and applying the instance of the corrective transformation to the feature vector to provide an enhanced feature vector.

2. The method as claimed in claim 1, wherein the acoustic feature vector is a cepstral vector, the distortion indicator is an attenuation indicator, the parametric corrective transformation is a parametric corrective function of quefrency and applying the instance of the corrective transformation is a component-wise multiplication of the feature vector by the corrective function.

3. The method as claimed in claim 2, wherein generating an instance of the corrective transformation is carried out for each emitted cepstral vector, or each phonetic unit.

4. The method as claimed in claim 2, wherein calculating a reference value of an attenuation indicator averages over the emission probability distribution specified by the phonetic unit.

5. The method as claimed in claim 2, wherein calculating an actual value of an attenuation indicator is based on said synthetic cepstral vector output from the system.

6. The method as claimed in claim 2, wherein generating an instance of the corrective transformation is carried out off-line prior to receiving said cepstral vector output from the system, and calculating an actual value of the attenuation indicator is based on a plurality of cepstral vectors generated by the system off-line and emitted from the phonetic unit.

7. The method as claimed in claim 2, wherein calculating the set of enhancing parameter values includes minimization of an enhancement criterion depending on the reference value of the distortion indicator, the actual value of the distortion indicator and the parametric corrective function, and representing a dissimilarity between the reference distortion indicator and a predicted value of the distortion indicator attributed to an enhanced synthetic vector.

8. The method as claimed in claim 7, further including altering the set of enhancing parameter values depending on external attributes associated with the statistical model emitting said cepstral vector.

9. The method as claimed in claim 8, wherein the external attributes include a phone category which the statistical model is attributed to and voicing class of the majority of speech frames used for the statistical model training.

10. The method as claimed in claim 2, wherein the parametric corrective function is an exponential function and the set of enhancing parameters is comprised of the exponent base.

11. The method as claimed in claim 2, wherein the parametric corrective function is a piece-wise exponential function that comprises at least two pieces, wherein at least one of the pieces spans two or more quefrency points, and wherein the set of enhancing parameters is comprised of the base values of the individual exponents and of the concatenation points.

12. The method as claimed in claim 2, wherein the attenuation indicator is a component-wise squared cepstral vector.

13. The method as claimed in claim 12, including smoothing of the attenuation indicator components by a symmetric positive filter.

14. The method as claimed in claim 1, wherein the statistical TTS system is a hidden Markov model (HMM) based TTS system employing Gaussian mixture emission probability distribution.

15. A computer program product for enhancement of speech synthesized by a statistical text-to-speech (TTS) system employing a parametric representation of short-time spectral envelope of speech in a space of acoustic feature vectors, the computer program product comprising:

a computer readable non-transitory storage medium having computer readable program code embodied therewith, the computer readable program code comprising:

computer readable program code configured to:

define a parametric family of corrective transformations operating in the space of the acoustic feature vectors and dependent on a set of enhancing parameters, wherein number of the enhancing parameters in the set of enhancing parameters is less than a dimension of the space of the acoustic feature vectors;

define a distortion indicator of a feature vector or a plurality of feature vectors, wherein the distortion indicator is not modelled directly by the statistical TTS system;

receive a feature vector output by the system;

generate an instance of the corrective transformation by:

calculating a reference value of the distortion indicator attributed to a statistical model of the phonetic unit emitting the feature vector;

calculating an actual value of the distortion indicator attributed to feature vectors emitted by the statistical model of the phonetic unit emitting the feature vector;

calculating the enhancing parameter values depending on the reference value of the distortion indicator, the actual value of the distortion indicator and the parametric corrective transformation;

deriving an instance of the corrective transformation corresponding to the enhancing parameter values from the parametric family of the corrective transformations; and applying the instance of the corrective transformation to the feature vector to provide an enhanced feature vector.

16. A system for enhancement of speech synthesized by a statistical text-to-speech (TTS) system employing a parametric representation of short-time spectral envelope of speech in a space of acoustic feature vectors, comprising:

a processor;

an acoustic feature vector input component for receiving an acoustic feature vector emitted by a phonetic unit;

a corrective transformation defining component for defining a parametric family of corrective transformations operating in the space of the acoustic feature vectors and dependent on a set of enhancing parameters, wherein number of the enhancing parameters in the set of enhancing parameters is less than a dimension of the space of the acoustic feature vectors;

an enhancing parametric set component including:

a distortion indicator reference component for calculating a reference value of a distortion indicator attributed to a statistical model of the phonetic unit emitting the feature vector;

a distortion indicator actual value component for calculating an actual value of the distortion indicator attributed to feature vectors emitted by the statistical model of the phonetic unit emitting the feature vector, wherein the distortion indicator is not modelled directly by the statistical TTS system; and wherein the enhancing parameter set component calculating the enhancing parameter values depending on the reference value of the distortion indicator, the actual value of the distortion indicator and the parametric corrective transformation;

a corrective transformation applying component for applying an instance of the corrective transformation to the feature vector to provide an enhanced feature vector.

17. The system as claimed in claim 16, wherein the acoustic feature vector is a cepstral vector and the distortion indicator is an attenuation indicator, the parametric corrective transformation is a parametric corrective function of quefrency and applying the instance of the corrective transformation is the component-wise multiplication of the feature vector by the corrective function.

18. The system as claimed in claim 17, wherein a distortion indicator reference component is an attenuation indicator component for calculating a reference value of the attenuation indicator averaged over the emission probability distribution specified by the phonetic unit.

19. The system as claimed in claim 17, wherein a distortion indicator actual value component is an attenuation indicator actual value component for calculating an actual value of the attenuation indicator based on said synthetic cepstral vector output from the system.

20. The system as claimed in claim 17, including:

an off-line enhancement calculation mechanism for deriving the enhancing parameters off-line prior to receiving cepstral vectors emitted from the phonetic unit, and wherein a distortion indicator actual value component is an attenuation indicator actual value component for calculating an actual value of an attenuation indicator based on a plurality of synthetic vectors generated off-line from a statistical model.

21. The system as claimed in claim 17, wherein the parametric corrective function is an exponential function and the set of enhancing parameters set is comprised of the exponent base.

22. The system as claimed in claim 17, wherein the parametric corrective function is a piece-wise exponential function and the set of enhancing parameters set is comprised of the base values of the individual exponents and of the concatenation points.

23. The system as claimed in claim 16, wherein the enhancing parameter set component includes an enhancement criterion applying component for calculating the enhancing parameter values for minimization of an enhancement criterion depending on the reference value of the distortion indicator, the actual value of the distortion indicator and the parametric corrective transformation, and representing a dissimilarity between the reference distortion indicator and a predicted value of the distortion indicator attributed to an enhanced synthetic vector.

24. The system as claimed in claim 16, wherein the statistical TTS system is a hidden Markov model (HMM) based TTS system employing Gaussian mixture emission probability distribution.

25. The system as claimed in claim 16, further including a customization component for altering the set of enhancing parameter values depending on attributes of the statistical model emitting said feature vector.

* * * * *